US009042758B2

(12) United States Patent
Kubo et al.

(10) Patent No.: US 9,042,758 B2
(45) Date of Patent: May 26, 2015

(54) IMAGE FORMING APPARATUS AND IMAGE FORMING PROGRAM

(71) Applicant: FUJI XEROX CO., LTD., Tokyo (JP)

(72) Inventors: Masahiko Kubo, Yokohama (JP); Jun Koyatsu, Yokohama (JP); Hideki Kimura, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 12 days.

(21) Appl. No.: 13/871,232

(22) Filed: Apr. 26, 2013

(65) Prior Publication Data

US 2014/0093267 A1 Apr. 3, 2014

(30) Foreign Application Priority Data

Oct. 2, 2012 (JP) ..... 2012-220685

(51) Int. Cl.
*G03G 15/20* (2006.01)
*G03G 15/01* (2006.01)
*G03G 15/00* (2006.01)

(52) U.S. Cl.
CPC ..... *G03G 15/2039* (2013.01); *G03G 15/0194* (2013.01); *G03G 15/2046* (2013.01); *G03G 15/6585* (2013.01)

(58) Field of Classification Search
USPC ..... 399/67, 69, 231, 341
See application file for complete search history.

(56) References Cited

U.S. PATENT DOCUMENTS 6,535,712 B2 * 3/2003 Richards ..... 399/341
6,920,304 B2 * 7/2005 Kanesawa et al. ..... 399/328
7,057,631 B2 * 6/2006 Nakamura et al. ..... 347/115
8,189,246 B2 * 5/2012 Washino ..... 358/540
8,494,385 B2 * 7/2013 Terao et al. ..... 399/53
8,529,009 B2 * 9/2013 Onishi ..... 347/16
8,559,831 B2 * 10/2013 Shifley ..... 399/16
8,565,633 B2 * 10/2013 Sonohara et al. ..... 399/69
8,655,252 B2 * 2/2014 Chiyoda ..... 399/341
8,733,923 B2 * 5/2014 Onishi ..... 347/102
2007/0065639 A1 * 3/2007 Iida et al. ..... 428/141
2009/0123204 A1 * 5/2009 Ng et al. ..... 399/341
2011/0116838 A1 * 5/2011 Shifley et al. ..... 399/223
2011/0116845 A1 * 5/2011 Shifley et al. ..... 399/299
2011/0206429 A1 * 8/2011 Terao et al. ..... 399/341
2011/0227984 A1 * 9/2011 Onishi ..... 347/16
2012/0107004 A1 * 5/2012 Sonohara et al. ..... 399/69
2012/0177426 A1 * 7/2012 Fujita et al. ..... 399/341
2012/0177427 A1 * 7/2012 Fujita et al. ..... 399/341

FOREIGN PATENT DOCUMENTS

JP 62-67558 A 3/1987
JP 2006-50347 A 2/2006
JP 2006317633 A 11/2006

* cited by examiner

*Primary Examiner* — David Gray
*Assistant Examiner* — Carla Therrien
(74) *Attorney, Agent, or Firm* — Sughrue Mion, PLLC

(57) ABSTRACT

There is provided an image forming apparatus including: a formation unit that forms an image using a color material, on a medium; a fusing unit that fixes the image formed on the medium; and a control unit that controls to perform both of a first fusing and a second fusing on the medium, wherein the first fusing is a fixation in which a first image is formed by using a color material with a metallic color and the first image formed is fixed, the second fusing is a fixation in which a second image is formed by using a color material with another color than the metallic color and the second image formed is fixed, and the first image and the second image are overlapped.

7 Claims, 5 Drawing Sheets

IMAGE FORMING APPARATUS AND IMAGE FORMING PROGRAM

CROSS-REFERENCE TO RELATED APPLICATION(S)

This application is based on and claims priority under 35 U.S.C. 119 from Japanese Patent Application No. 2012-220685 filed on Oct. 2, 2012.

BACKGROUND

1. Technical Field

The present invention relates to an image forming apparatus and an image forming program.

2. Related Art

When forming a color image, various colors are reproduced by using color materials with colors which are basic for forming a color image (hereinafter, referred to as basic colors), for example, color materials with C (cyan) M (magenta) Y (yellow) or color materials with R (red) G (green) B (blue). In a case of using CMY as the basic colors, a color material with K (black) is additionally used, in some cases. Further, a color material with a color other than the basic colors or K (hereinafter, referred to as a "spot color") is used, or a transparent color material is used, in some cases.

A metallic color is used as the spot color, in some cases. The metallic color is used for creating a glossy appearance or sparkle of metal. For example, JP-A-62-067558 discloses a technique to create a metallic appearance (metallic luster) such as a silver color or a gold color with an electrophotographic image forming apparatus, using metallic powder such as aluminum or brass as a color material. In addition, in JP-A-2006-050347, an image is formed so that a color material with a metallic color is disposed on a lowermost layer, and a color having a designated metallic appearance is reproduced, using a color material with a metallic color and a color material with a color other than the metallic color. Further, in JP-A-2006-317633, an image is formed so that a color material with a metallic color is disposed on an uppermost layer, and a metallic appearance (sparkle) is obtained.

In practice, if a color material is produced experimentally using a metallic pigment (aluminum), and a color material with a metallic color and a color material with the other color are superimposed onto each other to reproduce a given metallic color such as a gold color or the like, although the color material with a metallic color is disposed on an uppermost layer or a lowermost layer, the color reproduction is performed and a sparkle appearance is obtained. However, in both cases, a metallic glossy (Flop Index) obtained from the metallic spot color ink used in printing is not acquired.

FIGS. 5A and 5B are a schematic view of examples of cross sectional structures of an image formed by an image forming apparatus using a color material with a metallic color of the related art and an image printed using metallic spot color ink. In the drawing, reference numeral 21 denotes a medium, reference numeral 22 denotes a metallic pigment, and reference numeral 23 denotes a color material with a color other than a metallic color. FIG. 5A shows an example of a cross-sectional structure of an image in a case of forming an image by an electrophotographic image forming apparatus using a color material with a metallic color and a color material with the other color. In the electrophotographic image forming apparatus of the related art, the color material with a metallic color and the color material with the other color are superimposed onto each other to be formed on the medium 21 such as paper, and then, are heated and melted to be fixed. Since a thickness of a layer of the color material after the fixation is equal to or greater than a particle size of the color material with a metallic color, as shown in FIG. 5A, directions of metallic pigments 22 which are used as a color material with a metallic color are set to be uneven. Accordingly, specular directions on the surface of the metallic pigments 22 with respect to incident light are not even, and an amount of diffuse reflective light becomes relatively great, and thus, a glossy appearance is not acquired. Further, since the directions of the metallic pigments 22 are not even, surface roughness also becomes greater compared to a case of not using the color material with a metallic color. Also with this surface roughness of the image, specular reflectance is low and diffuse reflectance becomes to be high, and a glossy appearance is not acquired.

On the other hand, an example of a cross-sectional structure of an image in a case of printing using metallic spot color ink is shown in FIG. 5B. In a case of reproducing a metallic color in printing, printing is performed using metallic special color ink with a color to be reproduced. Accordingly, a thickness of an ink layer is smaller than a particle size of the metallic pigments 22 used in the metallic spot color ink, and directions of the metallic pigments 22 are restricted. Thus, orientation is high, the surface roughness of the image is small, the specular reflectance is high, and the diffuse reflectance is relatively low, compared to a case shown in FIG. 5A, and therefore a glossy appearance is acquired.

The present invention aims at providing an image forming apparatus and an image forming program which obtain a glossy appearance, even in an image in which various metallic colors are reproduced using color materials with given metallic colors and color materials with the other colors.

SUMMARY

There is provided an image forming apparatus including: a formation unit that forms an image using a color material, on a medium; a fusing unit that fixes the image formed on the medium; and a control unit that controls to perform both of a first fusing and a second fusing on the medium, wherein the first fixation is a fusing in which a first image is formed by using a color material with a metallic color and the first image formed is fixed, the second fixation is a fusing in which a second image is formed by using a color material with another color than the metallic color and the second image formed is fixed, and the first image and the second image are overlapped.

BRIEF DESCRIPTION OF DRAWINGS

Exemplary embodiments of the present invention will be described in detail based on the following figures, wherein.

DETAILED DESCRIPTION

Figure 1:
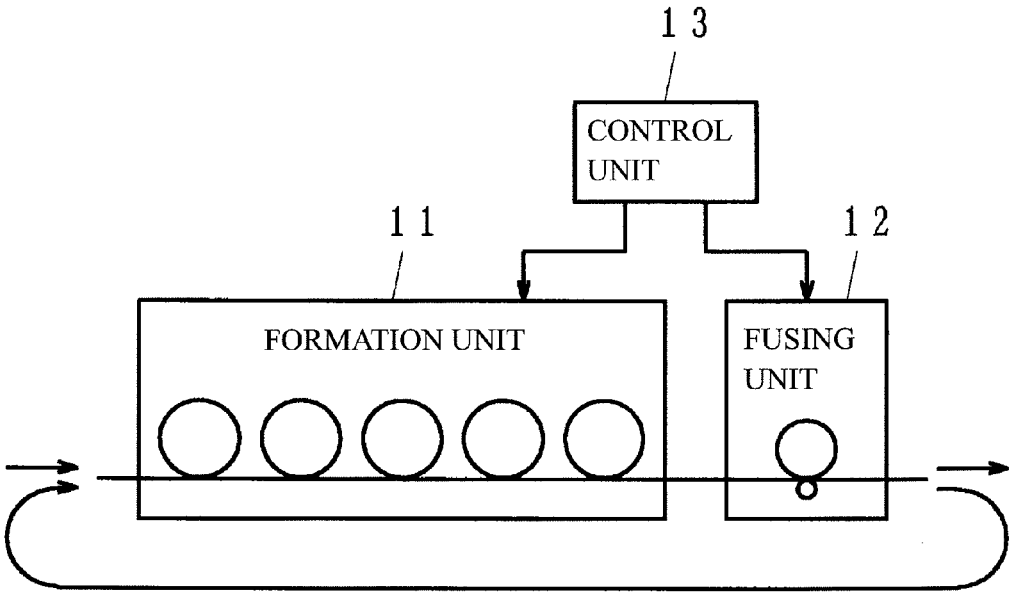
FIG. 1 is a configuration view showing an embodiment of the present invention.

FIG. 1 is a configuration view showing an embodiment of the present invention. In the drawing, reference numeral 11 is a formation unit, reference numeral 12 is a fusing unit, and reference numeral 13 is a control unit. The formation unit 11 forms an image using a color material with a metallic color and a color material with a color other than the metallic color, on a medium. In general, the configuration may be a configuration in a case of forming a color image, or for example, in which a tandem type, a cycle type, or any method of various methods such as a method of using or not using an intermediate transferring member, may be used. The color material with a color other than the metallic color may be a normal color material with a color used when forming a color image. In FIG. 1, a case of using color materials with four colors in addition to the color material with a metallic color is shown, however, the number of colors of the color materials with a color other than the metallic color may be three, or five or more. In addition, as an example of the color material with a color other than the metallic color, a transparent color material may be used. Further, there are various metallic colors, however, herein, a given color material with a metallic color is used, and a metallic color which is different from the metallic color of the color material, is reproduced by using a color material with a metallic color and a color material with a color other than the metallic color.

The fusing unit 12 fixes an image formed by the color material which is formed on the medium by a formation unit 11, on the medium. For example, a method of fixing the color material by heating may be used. Conditions at the time of fixing are controlled by the control unit 13.

The control unit 13 controls each unit, and performs control for forming an image on a medium. As the control in a case of forming an image using a color material with a metallic color, control is performed so that, one fixation of first fusing of forming an image using a color material with a metallic color by the formation unit 11 and fixing the image by the fusing unit 12, and second fusing of forming an image using a color material with a color other than the metallic color by the formation unit 11 and fixing the image by the fusing unit 12, is previously performed, and the other fixation is performed to be superimposed on the acquired image. For example, after an image using a color material with a metallic color is formed by the formation unit 11 and fixed by the fusing unit 12, the control of forming an image using a color material with a color other than the metallic color by the formation unit 11 and fixing the image by the fusing unit 12 to be superimposed on the acquired image, is performed. Alternatively, after an image using a color material with a color other than the metallic color is formed by the formation unit 11 and fixed by the fusing unit 12, the control of forming an image using a color material with the metallic color by the formation unit 11 and fixing the image by the fusing unit 12 to be superimposed on the acquired image, is performed.

In a case of using a color material with a metallic color, the control unit 13 sets fusing conditions which are different from that in a case of not using a color material with a metallic color, with respect to the fusing unit 12. The fusing conditions may be set so as to realize a glossy appearance, and for example, may be set so as to have a larger amount of energy to be applied at the time of fusing, compared to the case of not using a color material with a metallic color. In more detail, setting of various fusing conditions may be performed such as increasing a fusing temperature, decreasing a fusing speed, increasing fusing pressure, widening a fusing nip, and using a second fusing device in a configuration including the second fusing unit, compared to the case of not including the color material with the metallic color. The setting of the fusing conditions may be performed for any of the first fusing and the second fusing.

Figure 2:
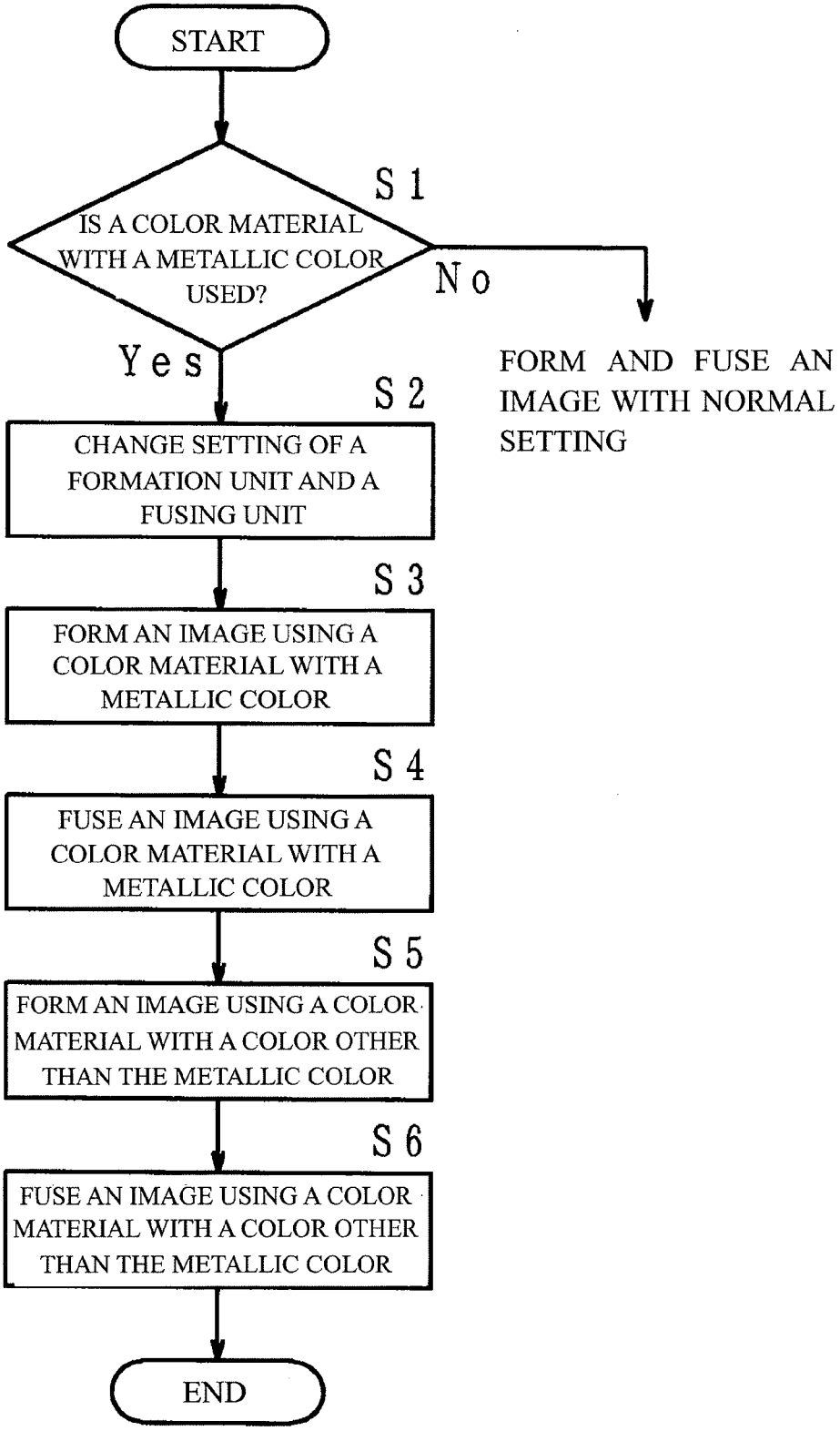
FIG. 2 is a flow chart showing an example of operations of an embodiment of the present invention.

FIG. 2 is a flowchart showing an example of operations of the embodiment of the present invention. In the operation example, an example of a case of forming an image using a color material with a metallic color first, and then forming an image using a color material with a color other than the metallic color, is shown.

First, in S1, the control unit 13 determines whether or not a color material with a metallic color is used for forming a given image. In a case of forming an image without using the color material with the metallic color, the given image is formed with the normal setting.

In a case of using the color material with the metallic color, in S2, the control unit 13 changes the setting with respect to the formation unit 11 and the fusing unit 12 so as to realize a glossy appearance. In S3, an image using the color material with the metallic color is formed on the medium by the formation unit 11, and the formed image is fixed on the medium by the fusing unit 12 in S4. When the formation and the fixation of the image by the color material with the metallic color is completed, the medium is returned to the formation unit 11 and the control unit 13 forms an image by the formation unit 11 using a color material with a color other than the metallic color in S5, and fixes the formed image by the fusing unit 12 in S6, to be superimposed on the image formed and fixed by the color material with the metallic color. As described above, a step of forming and fixing the image is performed two times.

In addition, the returning of the medium to the formation unit 11 is preferable to be automatically performed by including such a mechanism, but an operator may manually return the medium. Further, in a case of using the color material with the metallic color, the formation and the fixation of the image using the color material with the color other than the metallic color by S5 and S6 may be performed first, and the formation and the fixation of the image using the color material with the metallic color by S3 and S4 may be performed later.

Figure 3A:
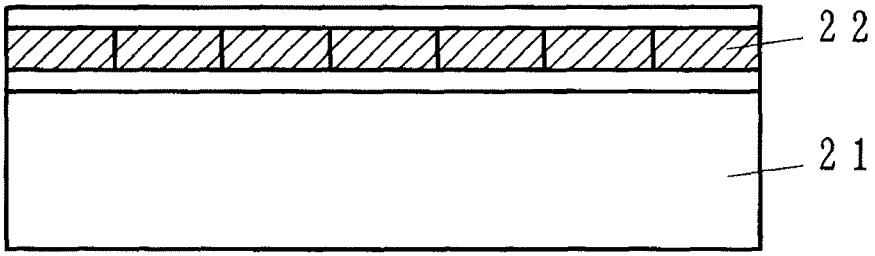
FIGS. 3A, 3B, and 3C are a schematic view of an example of a cross-sectional structure of an image formed by an embodiment of the present invention.
Figure 3B:
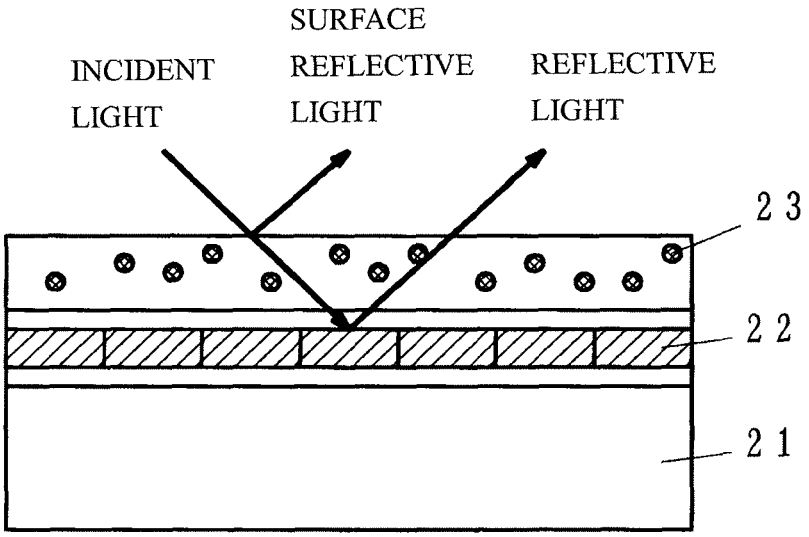
Figure 3C:
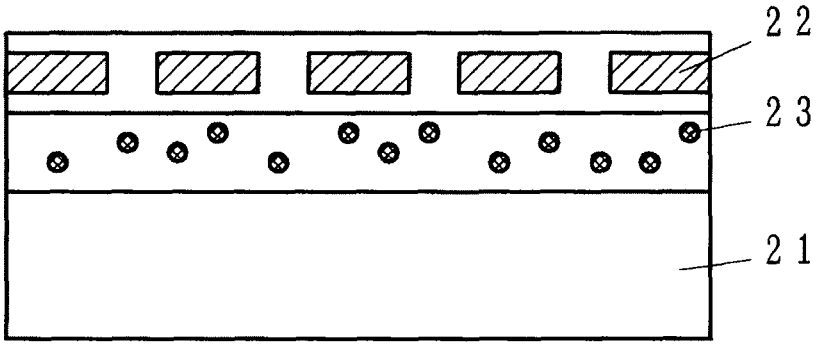

FIGS. 3A, 3B, and 3C are a schematic view of an example of a cross-sectional structure of an image formed by the embodiment of the present invention. FIG. 3A shows a state in which an image is formed and fixed using a color material with a metallic color, and FIG. 3B shows a state in which an image is further formed and fixed using a color material with a color other than the metallic color, from the state of FIG. 3A.

Figure 5A:
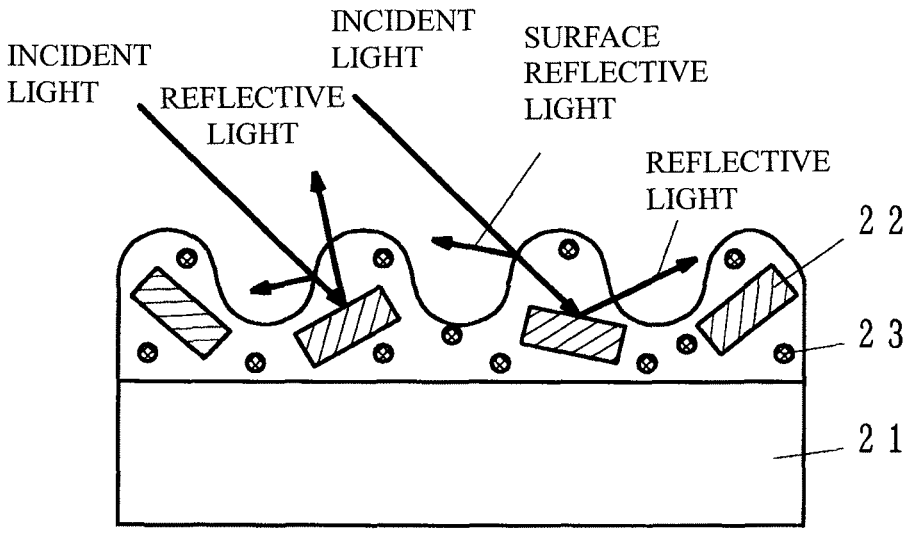
FIGS. 5A and 5B are a schematic view of examples of cross sectional structures of an image formed by an image forming apparatus using a color material with a metallic color of the related art and an image printed using metallic spot color ink.
Figure 5B:
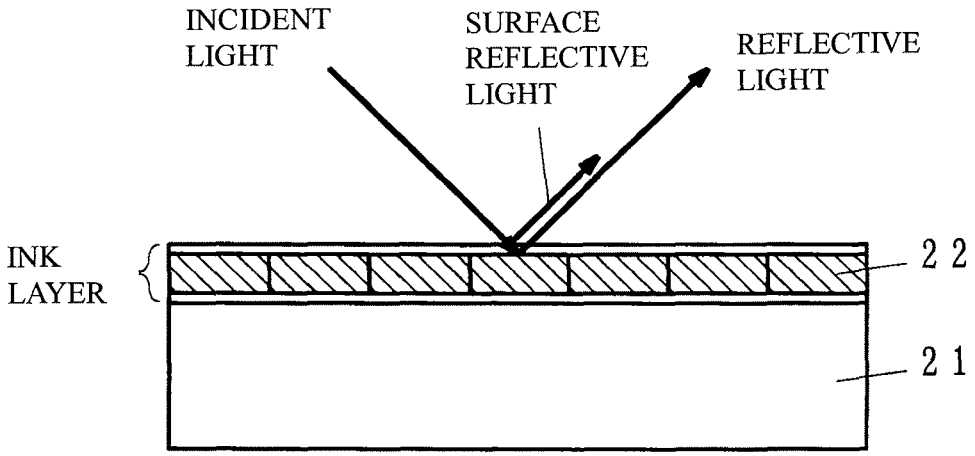

As shown in FIG. 3A, if an image is formed with a color material with a metallic color and is fixed, without using a color material with a color other than the metallic color, a thickness of a layer of the color material with the metallic color is small compared to that in a case of forming an image using both the color material with the color other than the metallic color and the color material with the metallic color, and directions of the metallic pigments 22 are restricted. Accordingly, orientation of the metallic pigments 22 in the color material with the metallic color becomes higher, compared to the case of forming and fixing an image using the color material with the metallic color and the color material with the color other than the metallic color shown in FIG. 5A. If a larger amount of energy than usual is applied and pressed more strongly than usual with respect to the fusing unit 12 at the time of the fixation, a layer of the color material with the metallic color is more reliably fixed to the medium 21 than usual, and the directions of the metallic pigments 22 in the color material with the metallic color become uniform.

If the image using the color material with the color other than the metallic color is further formed and fixed by being superimposed, from the state of FIG. 3A, the state becomes the state shown in FIG. 3B. Since the layer of the color material with the metallic color is already fixed, the orientation of the metallic pigments 22 is maintained. Accordingly, the specular directions by the metallic pigments 22 with respect to incident light become uniform, diffuse reflectance becomes relatively low, compared to the example of the related art shown in FIG. 5A, and the glossy appearance is acquired. In addition, if a larger amount of energy than usual is applied at the time of fixing the color material with the color other than the metallic color, a surface of the layer of the color material with the color other than the metallic color becomes smooth, and even more glossy appearance is acquired by surface reflection. Further, in the case of this example, since the color material 23 with the color other than the metallic color is not hidden by the metallic pigments 22, color reproduction is performed.

In FIG. 3C, a case of forming and fixing of an image using a color material with a metallic color after forming and fixing an image using a color material with a color other than the metallic color, is shown. In this case, before forming an image using a color material with a metallic color, an image using a color material with a color other than the metallic color is already formed and fixed. Accordingly, a layer of the color material with the metallic color which is superimposed on a portion where a layer with the color material with the color other than the metallic color is fixed, is smaller compared to a case of forming an image using both of the color material with the metallic color and the color material with the color other than the metallic color, and the orientation of the metallic pigments 22 in the color material with the metallic color becomes high. Thus, accordingly, the specular directions by the metallic pigments 22 with respect to incident light become uniform, diffuse reflectance becomes relatively low compared to the case of the related art, and the glossy appearance is acquired. In the case of this example, the reflective light in the metallic pigments 22 does not pass through the layer of the color material with the color other than the metallic color, and the glittering appearance is increased compared to the case of FIG. 3B, however, the reproduction performance of the color is degraded.

In addition, when fixing the layer of the color material with the color other than the metallic color and the layer of the color material with the metallic color in the example shown in FIG. 3C, in the fixation of each layer, a larger amount of energy than usual may be applied and pressed more strongly than usual, with respect to the fusing unit 12. A surface of the layer of the color material with the color other than the metallic color becomes smooth, the directions of the metallic pigments 22 in the layer of the color material with the metallic color become uniform, and even more glossy appearance is acquired by reflective light on the surface. The directions of the metallic pigments 22 in the layer of the color material with the metallic color also become uniform.

Figure 4:
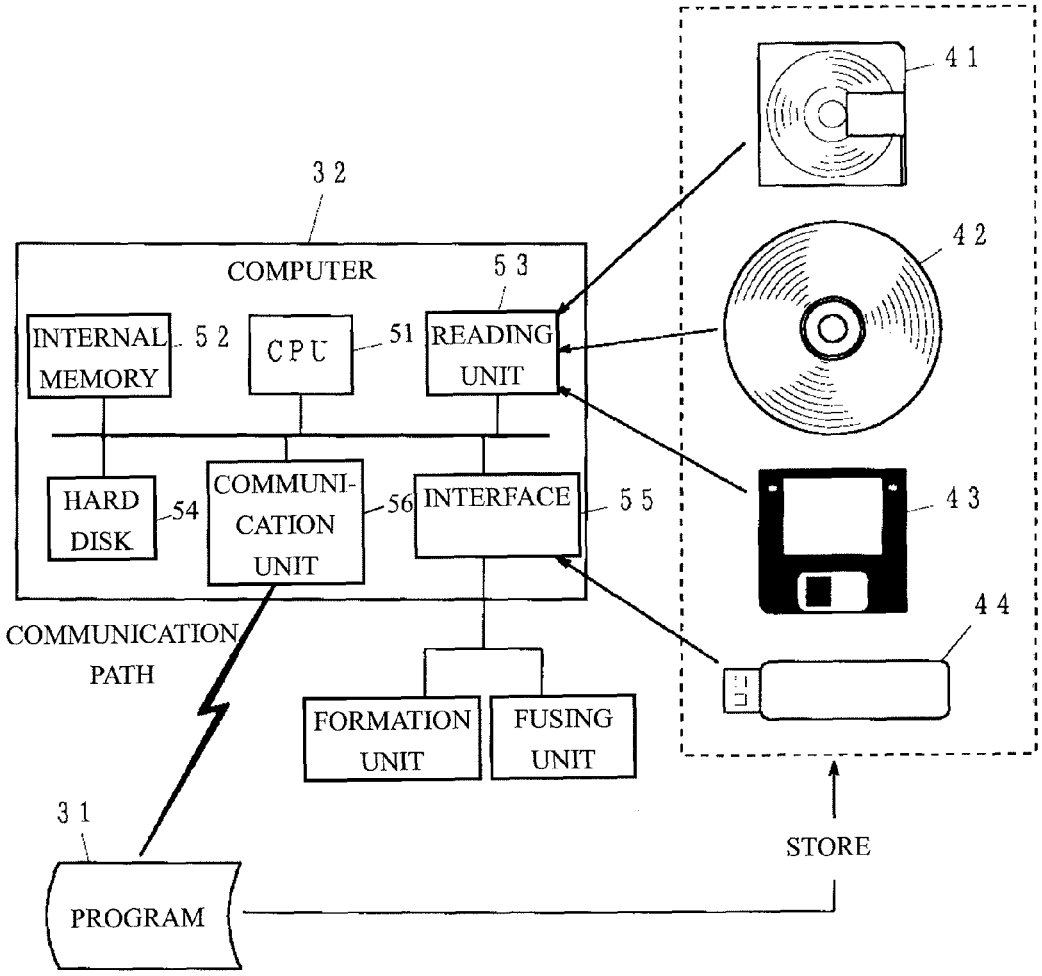
FIG. 4 is an explanatory view of an example of a computer program, a memory medium which stores the computer program, and a computer, in a case of realizing a function described in the embodiment of the image forming apparatus of the present invention with a computer program.

FIG. 4 is an explanatory view of an example of a computer program, a memory medium which stores the computer program, and a computer, in a case of realizing a function described in the embodiment of the image forming apparatus of the present invention with a computer program. In the drawing, reference numeral 31 denotes a program, reference numeral 32 denotes a computer, reference numeral 41 denotes a magneto-optical disc, reference numeral 42 denotes an optical disc, reference numeral 43 denotes a magnetic disk, reference numeral 44 denotes a memory, reference numeral 51 denotes a CPU, reference numeral 52 denotes an internal memory, reference numeral 53 denotes a reading unit, reference numeral 54 denotes a hard disk, reference numeral 55 denotes an interface, and reference numeral 56 is a communication unit.

The entire or the partial function of the control unit 13 described in the embodiment of the image forming apparatus of the present invention described above may be realized by the program 31 which is executed by the computer. In this case, the program 31 and data or the like used by the program may be stored in a memory medium readable by the computer. The memory medium is a medium which causes a changing state of an energy such as magnetism, light, power, or the like, according to the description content of the program, with respect to the reading unit 53 included in hardware resources of the computer, and transmits the description content of the program to the reading unit 53 in a form of a signal corresponding to the state. For example, the magneto-optical disc 41, the optical disc 42 (including a CD or a DVD), the magnetic disc 43, the memory 44 (including an IC card, a memory card, or a flash memory) are used. Of course, such memory media are not limited to a transportable type.

The program 31 is stored in such memory media, the memory media are mounted on the reading unit 53 or the interface 55 of the computer 32, for example, the program 31 is read out from the computer and stored in the internal memory 52 or the hard disk 54 (including magnetic disk or a silicon disk), and the program 31 is executed by the CPU 51, and the entire or the partial function of the control unit 13 described in the embodiment of the image forming apparatus of the present invention described above is realized. Alternatively, the program 31 may be transmitted to the computer 32 through a communication path, and in the computer 32, the program 31 may be received by the communication unit 56 and recorded in the internal memory 52 or the hard disk 54, and the program 31 may be executed by the CPU 51.

The formation unit 11 and the fusing unit 12 are connected to the computer 32 through the interface 55, and the formation unit 11 and the fusing unit 12 are controlled by the program 31 to acquire an image. Additionally to this, various devices may be connected thereto through the interface 55. In addition, it is not necessary to perform operation in just one computer, and the process may be executed by the other computer according to the process stage. In a case of applying for other purposes, the formation unit and the fusing unit may be configured to be integrated with the program for other purposes. Further, the formation unit and the fusing unit may be partially configured with the hardware, or may be entirely configured with the hardware.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a control unit configured to control a fusing unit to perform both of a first fusing and a second fusing, wherein the first fusing is a fixation in which a first image formed on a medium by using a color material having a metallic color and comprising metal particles is fixed, wherein the second fusing is a fixation in which a second image formed on the medium by using a color material having a color other than the metallic color is fixed, wherein the second image is overlapped with the first image, and wherein the control unit is configured to control fixation conditions so that a larger amount of energy is applied during the first fusing as compared to the second fusing.

2. The image forming apparatus according to claim 1, wherein the first fusing is performed prior to the formation of the second image.

3. The image forming apparatus according to claim 1, wherein a fusing temperature in the first fusing is higher compared to the second fusing.

4. The image forming apparatus according to claim 1, wherein a fusing speed in the first fusing is lower compared to the second fusing.

5. The image forming apparatus according to claim 1, wherein a fusing pressure in the first fusing is higher compared to the second fusing.

6. The image forming apparatus according to the claim 1, wherein the second fusing is performed prior to the formation of the first image.

7. A non-transitory computer readable medium storing a program causing a computer to execute a process for forming an image, the process comprising:

controlling a first fusing and a second fusing, wherein the first fusing is a fixation in which a first image formed on a medium by using a color material having a metallic color and comprising metal particles is fixed, wherein the second fusing is a fixation in which a second image formed on the medium by using a color material having a color other than the metallic color is fixed, wherein the second image is overlapped with the first image, and wherein the controlling comprises controlling fixation conditions so that a larger amount of energy is applied during the first fusing as compared to the second fusing.

* * * * *